US006094474A

United States Patent [19]

Vezina

[11] Patent Number: 6,094,474

[45] Date of Patent: Jul. 25, 2000

[54] HYPER-TRANSPARENCY COMPENSATING DEVICE FOR A GANTRY MOUNTING RADIOGRAPHY APPARATUS

[75] Inventor: Jean A. Vezina, Montréal, Canada

[73] Assignee: Octostop, Inc., Montreal, Canada

[21] Appl. No.: 09/183,357

[22] Filed: Oct. 30, 1998

[51] Int. Cl.[7] ..... G21K 3/00

[52] U.S. Cl. ..... 378/156; 378/157; 378/158; 378/159

[58] Field of Search ..... 378/156, 157, 378/158, 159

[56] References Cited

U.S. PATENT DOCUMENTS

| | | | |
|---|---|---|---|
| 4,053,781 | 10/1977 | Hounsfield | 378/18 |
| 4,472,828 | 9/1984 | Ferlic | 378/147 |
| 4,497,062 | 1/1985 | Mistretta et al. | 378/158 |
| 5,369,678 | 11/1994 | Chiu et al. | 378/62 |
| 5,454,023 | 9/1995 | Asikainen | 378/156 |
| 5,483,572 | 1/1996 | Hoornaert et al. | 378/156 |
| 5,568,533 | 10/1996 | Kumazaki et al. | 378/156 |

FOREIGN PATENT DOCUMENTS 2195798 2/1997 Canada .

2189468 1/1998 Canada .

*Primary Examiner*—David P. Porta
*Assistant Examiner*—Allen C. Ho
*Attorney, Agent, or Firm*—Pearson & Pearson

[57] ABSTRACT

The device is used for compensating a hyper transparency area due to air inside or outside an organ while using a gantry mounting radiography apparatus with digital subtraction (DSA). The device comprises compensating filters and a supporting assembly for connecting the filters in front of the X-ray source. Each filter extends in a filter plane while the organ defines a median plane in which the rotation axis of the arms of the apparatus is substantially lying. The supporting assembly is designed to keep the filter in front of the X-ray source and in registry with the X-ray source and the hyper transparency area while keeping the filter plane parallel to the reference plane during rotation of the arms. Unlike existing X-ray compensating devices which are stationary, the present invention automatically sets itself for radiography of different views in function of the rotation of the arms of the apparatus. It is well adapted for performing arteriographies and, in particular, allows the peripheral arterioles to be seen.

15 Claims, 9 Drawing Sheets

HYPER-TRANSPARENCY COMPENSATING DEVICE FOR A GANTRY MOUNTING RADIOGRAPHY APPARATUS

The present application claims the benefit of U.S. provisional patent application Ser. No. 60/064,114, filed on Nov. 03, 1997, which is hereby incorporated by reference.

BACKGROUND OF THE INVENTION

The gantry mounting radiography apparatus is a sophisticated X-ray electronic apparatus that may be used, in particular, to perform arteriographies. Arteriographies are the examination of the arteries using X-rays following an injection of a radiopaque substance. Since the X-ray images are in two dimensions, X-rays are taken at different angles to be able to get a three-dimensional view of arteries and their possible pathologies, such as aneurysms. A digital subtraction technique is used to isolate the injected radiopaque substance from the global X-ray image. According to this technique, a first X-ray image is taken before the injection of the radiopaque substance and a second is taken immediately after the injection. The two images are digitalized and subtracted in a computer The radiopaque substance is then clearly visible on the resulting image to show the details of the analysed arteries. In a gantry mounting apparatus, images are taken at different angles in a rapid succession so that only one injection of radiopaque substance is necessary.

When making an arteriography, the hyper radiation due to air inside or outside the analysed organs seriously degrades the images by saturating some areas. No useful information is obtained from a saturated area because the halation creates an overexposed zone. Yet, compensating the hyper transparency of an organ, such as the lungs inside the human body, is quite delicate. On one hand, the hyper radiation is very difficult to compensate electronically due to the inherent remanence of the X-ray tube amplifier of the apparatus. On the other hand, a common solution is to restrict the size of the area to analyse by closing the diaphragm of the X-ray source in order to avoid the halation due to air at the periphery of the body, such as the periphery of the head or the neck of the patient. However, restricting the analysed area may prevent the specialist from seeing the peripheral arterioles and thus some possible pathologies.

Some attempts were made for correcting the saturation problems by using metal compensating plates, curved or wedged, set directly against the patient or near the image device. Although sufficient for a simple radiography, they are not always adequate for all incidences required in multiple angle arteriography. For example, U.S. Pat. No. 4,472,828 describes an X-ray filter for chest X-rays which operation principle is similar to the one of the metal compensating plates This device may improve the image of the radiography about the thorax, but it is stationary and as a result, it limits radiography to one view of the organ at a time and has to be reset for a different view.

SUMMARY OF THE INVENTION

It is an object of the present invention to provide a device that is designed to be used with a gantry mounting radiography apparatus to allow a suitable internal or external compensation of the hyper transparency areas, independently of the positioning of the two opposite arms of the apparatus.

More particularly, the object of the present invention is to provide a hyper-transparency compensating device for a gantry mounting radiography apparatus. The apparatus has a first and second opposite arms rotatable around a rotation axis, The first arm supports an X-ray source and the second arm supports an X-ray tube amplifier that is in registry with the X-ray source. The apparatus is used for performing X-rays of an organ. That organ defines a median plane in which the rotation axis is substantially lying.

The device comprises at least one compensating filter defining a filter plane, and a supporting assembly to connect the filter to the first arm of the gantry mounting apparatus, in front of the X-ray source and in registry with the X-ray source and the hyper transparency area while keeping the filter plane parallel to the reference plane during rotation of the arms.

A non restrictive description of preferred embodiments will now be given with reference to the appended figures.

IDENTIFICATION OF THE COMPONENTS

Figure 1:
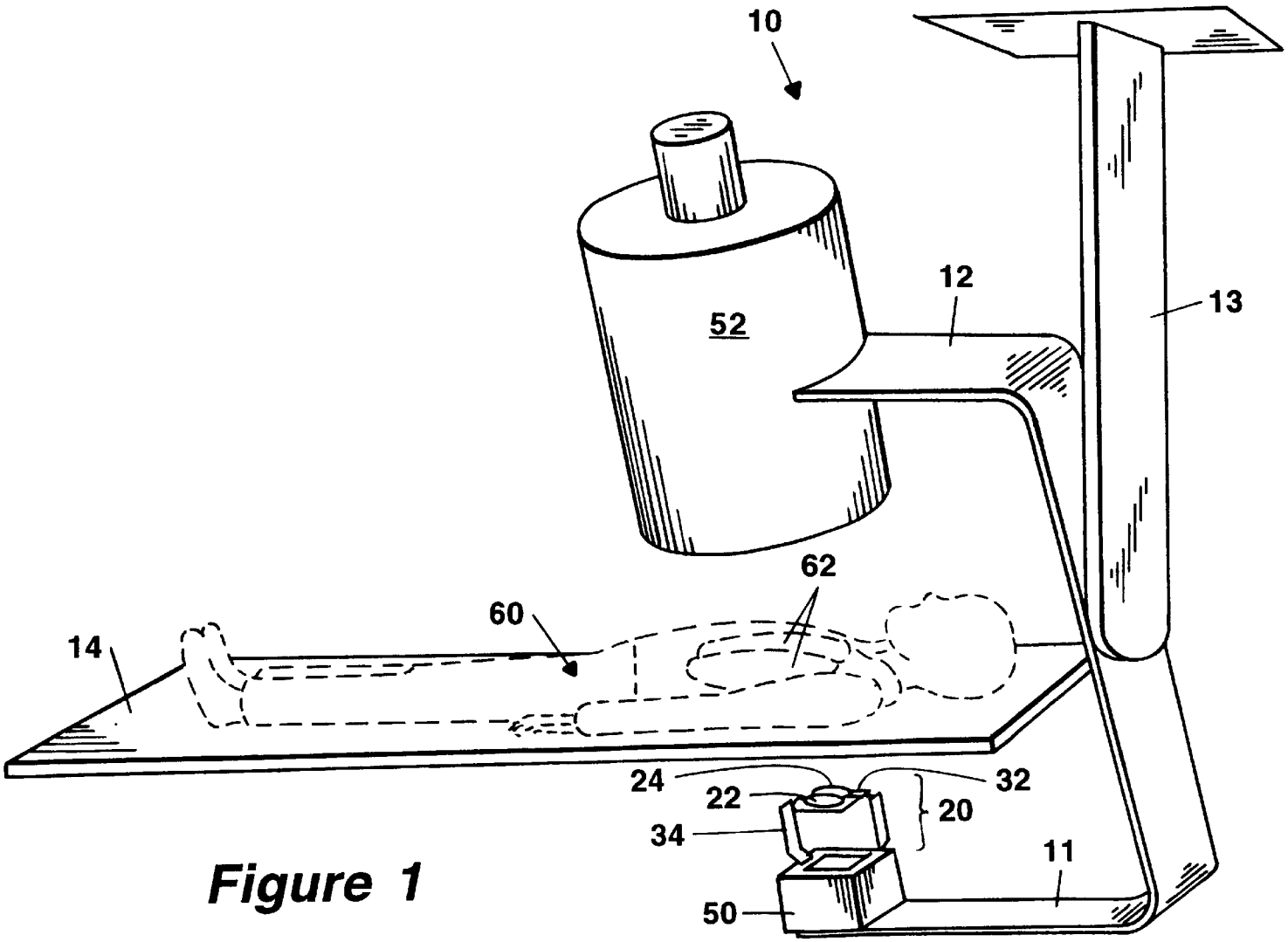
FIG. 1 is a perspective view of the device according to a first possible embodiment of the present invention, showing an example of an internal compensation for the air inside the lungs of a patient.

The following is a list of the reference numerals, along with the names of the corresponding components, that are used in the appended figures and in the description.

| | |
|---|---|
| 10 | gantry mounting radiography apparatus |
| 11 | first arm |
| 12 | second arm |
| 13 | vertical arm |
| 14 | table |
| 20 | compensating device |
| 21 | filter plane |

-continued

| | |
|---|---|
| 22 | left lung compensating filter (for internal compensation) |
| 24 | right lung compensating filter (for internal compensation) |
| 31 | axes |
| 32 | supporting plate |
| 34 | arms (of the supporting assembly) |
| 36 | hooks |
| 40 | support |
| 42 | arms (of the support) |
| 50 | X-ray source |
| 52 | X-ray tube amplifier |
| 60 | patient |
| 62 | lungs (of the patient) |
| 63 | median plane (of the organ) |
| 64 | head (of the patient) |
| 66 | T-shaped compensating filters (for external compensation) |
| 70 | star-shaped compensating filter (for external compensation) |
| 72 | flat top portion (of a T-shaped compensating filter) |
| 74 | side openings |
| 100 | cervical peripheral filter |
| 102 | neck peripheral filter |
| 104 | head peripheral filter |
| 106 | full face mask peripheral filter |
| 108 | partial face mask peripheral filter |
| 110 | straps |
| 112 | foam pillow |

DETAILED DESCRIPTION OF PREFERRED EMBODIMENTS

Gantry mounting radiography apparatus

FIG. 1 is a general representation of the rotating gantry mounting radiography apparatus (10). The apparatus (10) comprises two opposite arms (11,12). The opposite arms (11,12) are connected to each other, forming a fork and are attached to a vertical arm (13) of the apparatus (10) at substantially the center of the fork. The connection point of the two opposite arms (11,12) to the apparatus (10) allows rotation of an X-ray source (50), and an X-ray tube amplifier (52) around a patient (60) or any other object that has to be analysed. The first arm (11) bears the X-ray source (50) while the second arm (12) bears the amplifier (52).

The attaching point of the two opposite arms (11,12) defines a rotation axis that usually lies in a horizontal plane. The patient (60) rests on a horizontal table (14) and the height if the table (14) is set in order that the rotation axis of the apparatus (10) be aligned as close as possible with the center of the analysed organ. This setting maintains the X-ray source (50), the organ and the X-ray tube amplifier (52) constantly in registry with each other, independently of the rotation of the arms (11,12).

In use, the X-ray source (50) generates an X-ray beam aimed at the X-ray tube amplifier (52). A collimator in the X-ray source (50) is used to limit the width of the beam. The organ or organs, for instance the lungs (62) of the patient (60), are scanned by the apparatus (10) at various angular positions. The data are collected by the amplifier (52) and are sent to a computer (not shown) for reconstructing the images by digital subtraction (DSA). These images will be later analysed by the specialist. Alternatively, the amplifier (52) can be replaced by a film.

Internal compensation

Figure 2:
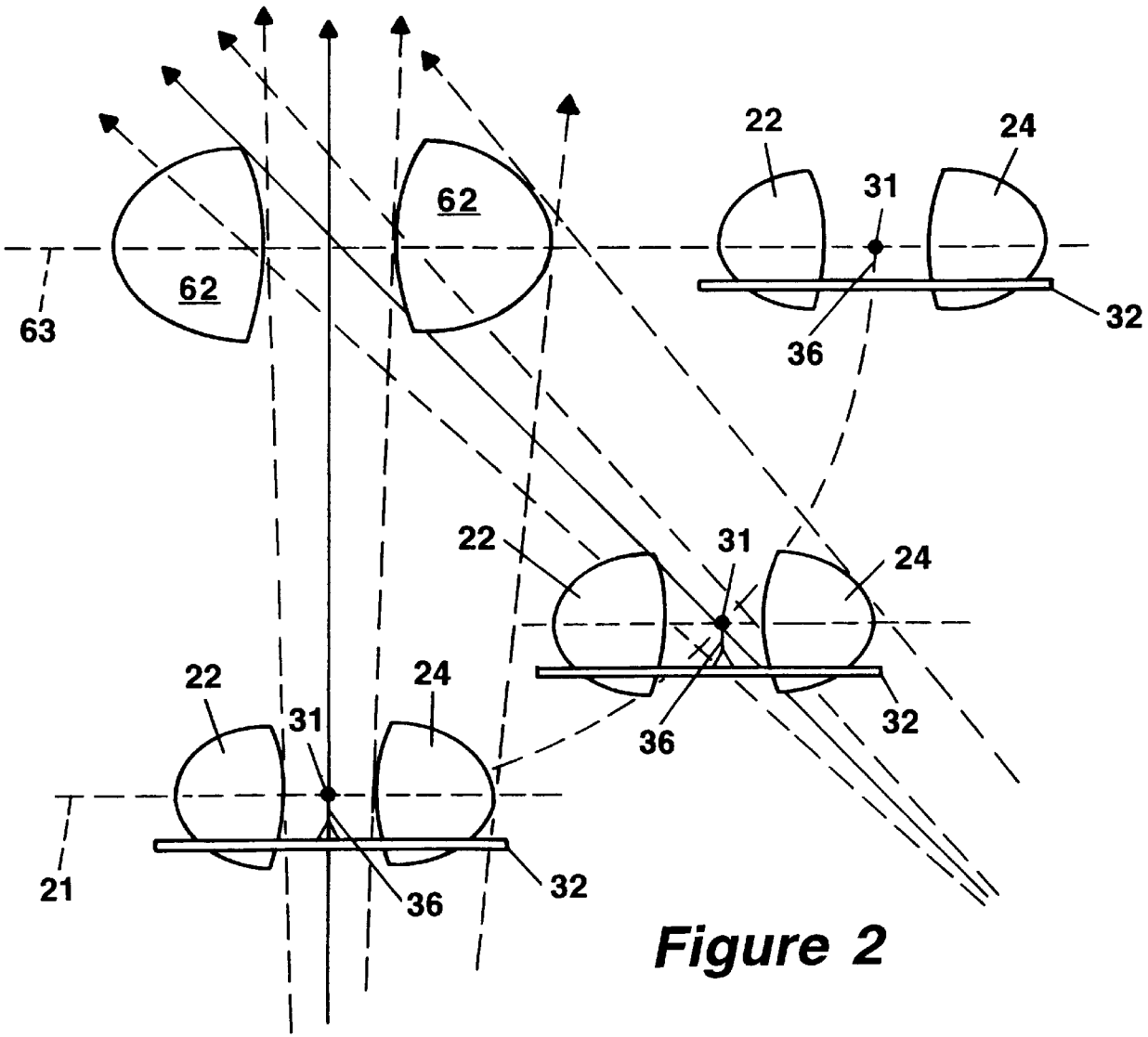
FIG. 2 is an enlarged schematic view of the device of FIG. 1, showing the pair of lung filters in three different positions.

FIG. 2 shows an example of an internal compensation of the hyper transparency of the lungs (62), due to the air therein, using a compensating device (20) according to a possible embodiment of the present invention. Other organs can also be compensated in a same manner, such as the bladder (not shown), In the case of the lungs, a pair of the three-dimensional compensating filters is used, namely a left (22) and a right filter (24). Each filter (22,24) is in registry with a corresponding lung (62) of the patient (60) and is roughly a three-dimensional scaled representation of the corresponding human lung (62), preferably of an average size. The volume of the filters (22,24) is reduced in the inverse ratio of the distance to the focal point of the X-rays and the distance of the lungs (62) of the patient (60) to the focal point. Commonly, if the filter is 50% closer than the lungs (62) of the patient (60), its volume is 50% of the size thereof. A filter of 33% of the size of the lungs (62) would be located at ⅓ of the distance. It preferably has a volume between ½ and ⅓ of the volume of such average human lungs, depending on their relative position with reference to the patient (60). In general, it is desirable that the image density of the compensated lungs (62) attain the density of the tissues located around them, which is that of water or muscles. Therefore, the compensation required from the filters (22, 24) depends on their size. As an example, if the filters (22,24) are twice as small as the lungs (62) of the patient (60), their absorption will be about twice the one of water. One possible material is polyurethane.

The penumbra created by the filters (22,24) is usually sufficient for a gradual demarcation of the shadow, but a thin coating of a slightly less absorbing material (not shown) would diminish such demarcation.

As shown in FIG. 1, the pair of filters (22,24) is supported by a supporting assembly comprising a plate (32) and opposite arms (34) which allow the filters (22,24) to be held in position on the first arm (11) and in front of the X-ray source (50). In accordance with the present invention, the filters (22,24) define a plane, called the filter plane (21), which remains substantially parallel to a median plane (63) defined by the organ, such as the lungs (62) of the patient (60). In the embodiment shown in FIGS. 1 and 2, both planes are horizontal. The supporting assembly is attached to the X-ray source (50), preferably by means of a Velcro™ band or any other suitable means, as apparent to a person skilled in the art.

In use, the filters (22,24) remain in registry with the X-ray source (50), the lungs (62) of the patient and the amplifier (52), and simultaneously the filter plane (21) remains parallel to the median plane (63), as shown in FIG. 2. This creates a shadow of radiation over the desired portion of the lungs (62) to be X-rayed in function of the angle of the arms (11,12). FIG. 2 shows examples of three different positions for the compensating device (20) with reference to the lungs (62) of the patient (60).

Preferably, the filter plane (21) remains parallel to the median plane (63) of the organ under the effect of gravity. To do so, the supporting assembly may comprise an axis (31), such as a cord or a bar, on which the filters (22,24) are hung. The axis (31) is 30 transparent to X-rays to allow X-rays to be absorbed uniformly by the filters (22,24), preventing, hence, disruption of its regular pathway. An example of such material is Nylon™. The axis (31) extends between two opposite arms (34) and is preferably adjustable in height. This axis (31) can also be placed near each opposite arm (34), outside the radiation beam, and made of metal.

The plate (32) is held on the axis (31), preferably by means of hooks (36) which also allow a longitudinal sliding of the plate (32). The distance between the filters (22,24) and the X-ray source (50) may also be changed if proper means are provided therefor. Of course, one may choose to provide a supporting assembly with a motorised actuator (not shown) for keeping the filter plane (21) parallel to the median plane (63).

External compensation

The external compensating device (20) is similar to the internal compensating device, except that peripheral filters are used to eliminate the unfiltered radiation and halation around the organ or organs to analyse.

Figure 3:
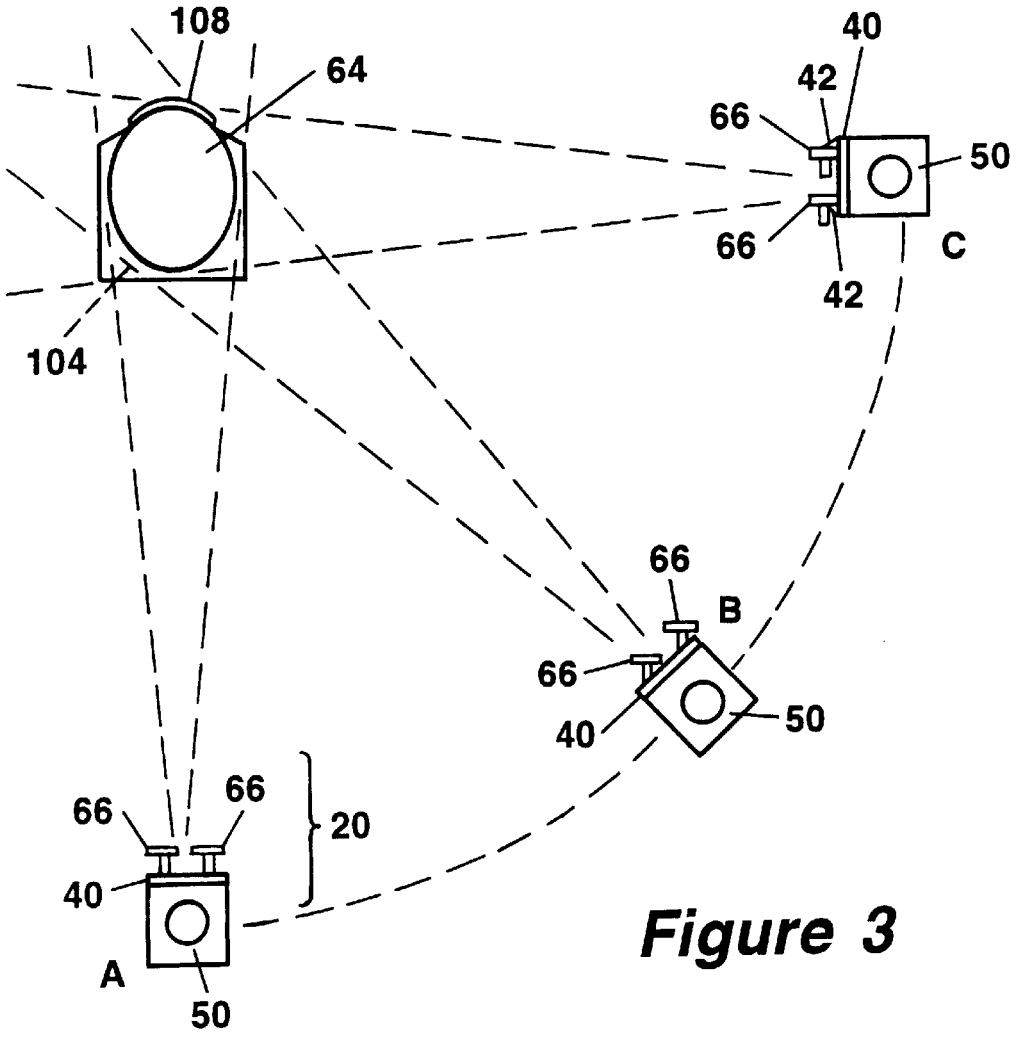
FIG. 3 is a schematic view of the device according to a second possible embodiment of the present invention, showing an example of an external compensation of the air around the head of a patient.

As shown in FIG. 3, the compensating device (20) comprises two elongated filters (66), preferably T-shaped, that are mounted on a support (40). The support (40) is removably attached over the X-ray source (50). The filters (66) are parallel to each other and have a heavier lower portion so that they remain parallel to a horizontal plane during the motion of the arms (11) of the apparatus (10). Alternatively, it is possible to use a motorised alignment instead of gravity. The filters (66) are freely rotatable around a longitudinal axis, preferably horizontal, extending between the two adjustable arms (42) of the support (40). The positions of the pair of arms (42) may be adjusted to obtain a larger or smaller opening. The base of the support (40) and the arms (42) are made of a material transparent to X-rays. As for the filters (66), it is possible to use a plastic material or lead. Two or more materials may also be combined together. Unlike the internal compensation, it is often required that all X-rays be blocked completely to prevent saturation around the organ to analyse. A gradual demarcation is preferred around the edge of the organ to analyse since it is not possible to always perfectly align the filters (66) with reference to the organ.

In FIG. 3, one can see that the distance between the filters (66) at position A is smaller than the distance between the same filters (66) at position C.

Figure 4:
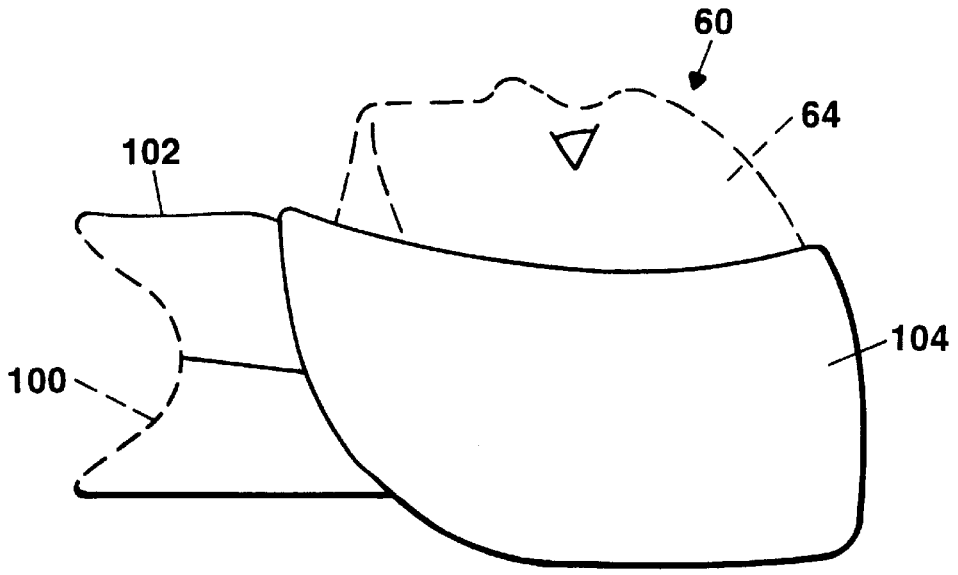
FIG. 4 is a side view of cervical, neck and head peripheral filters that are used with the device shown in FIG. 3.
Figure 5:
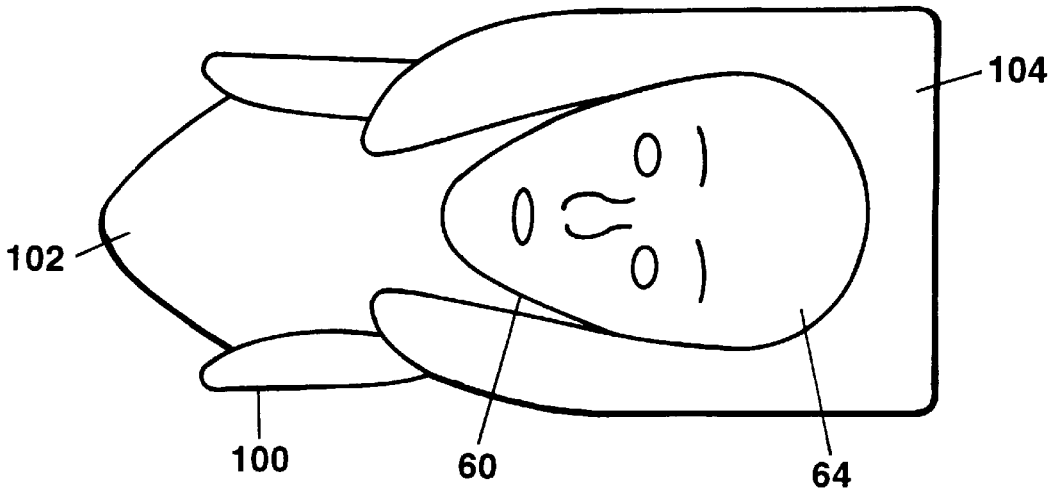
FIG. 5 is a top view the peripheral filters shown in FIG. 4.
Figure 6:
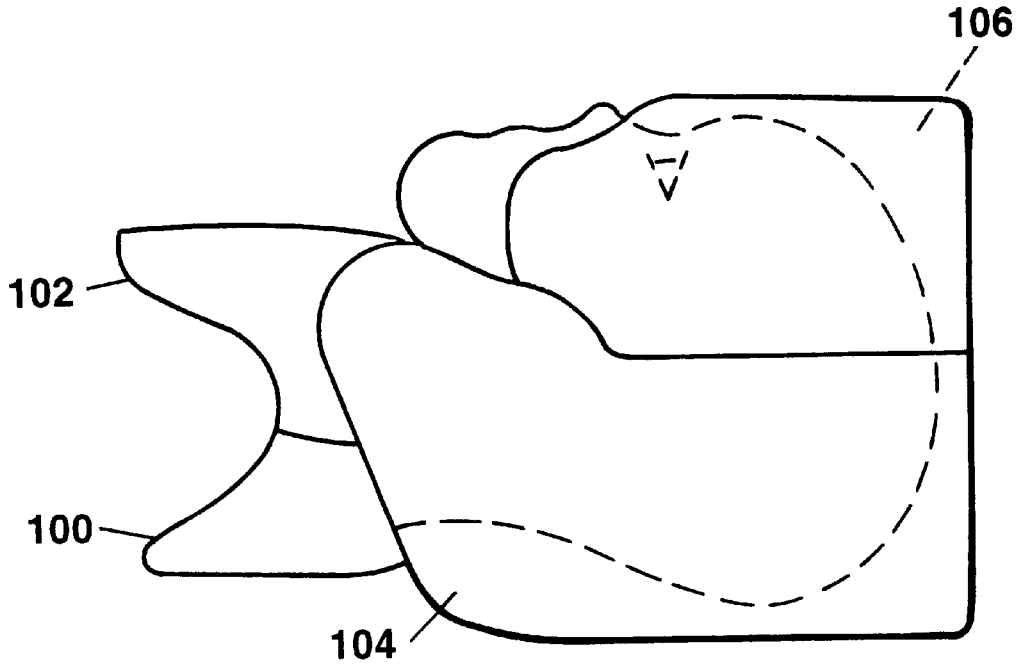
FIG. 6 is a side view of the peripheral filters of FIGS. 4 and 5, with the addition of a full face mask peripheral filter.
Figure 7:
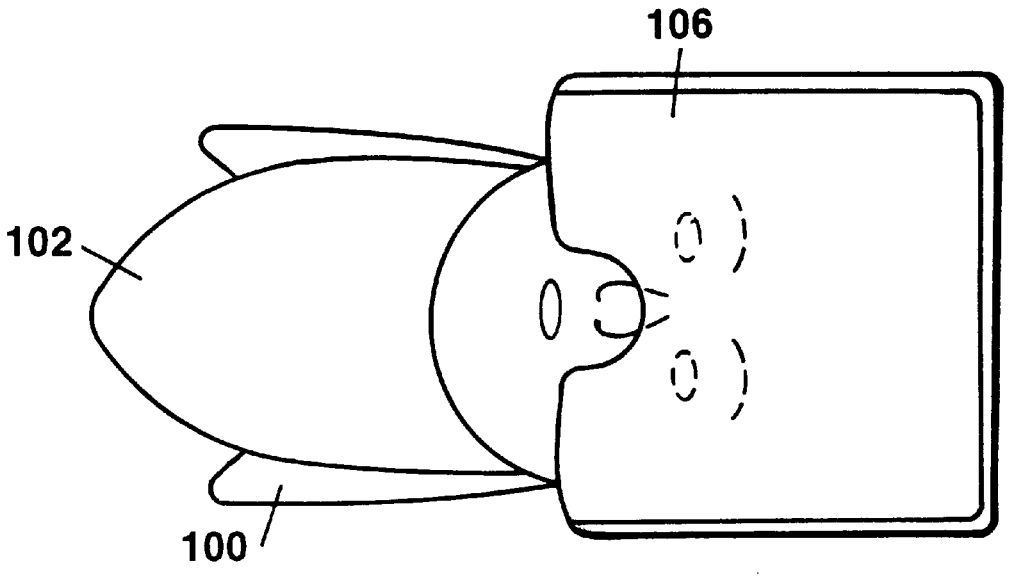
FIG. 7 is a side view of the peripheral filters shown in FIG. 6.
Figure 8:
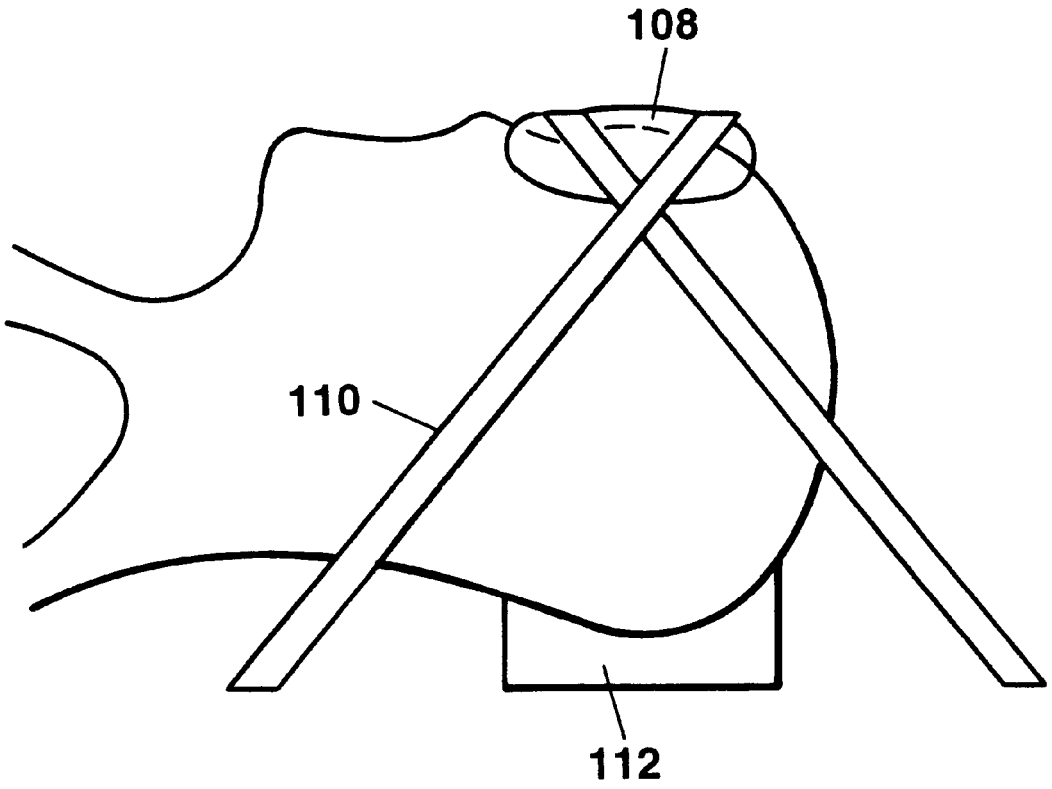
FIG. 8 is a side view of a partial face mask peripheral filter.

Peripheral filters set around the head (64) and the face of the patient (60) further reduce the halation. Examples of peripheral filters are shown in FIGS. 4 to 8. In FIGS. 4 and 5, the patient (60) has a cervical filter (100), a neck filter (102) and a head filter (104). A full face mask filter (106), shown in FIGS. 6 and 7, may be used in addition to the other filters (100,102,104). However, a partial face mask (108) is usually preferred since it fulfils most of the needs. This mask (108) may be used with straps (110) for immobilisation. Yet, a foam pillow (112) is usually set under the head (64) of the patient (60).

The peripheral filters (100,102,104,106,108) are made of a flexible and transparent material that absorbs the radiation, such as polyurethane. This material preferably has a radiation absorption similar to that of water. The filters (100,102, 104,106,108) are mainly used to attenuate the demarcation between the organ and the air, thereby reducing the chances of image saturation. They also provide some immobilisation of the patient (60).

Figure 10:
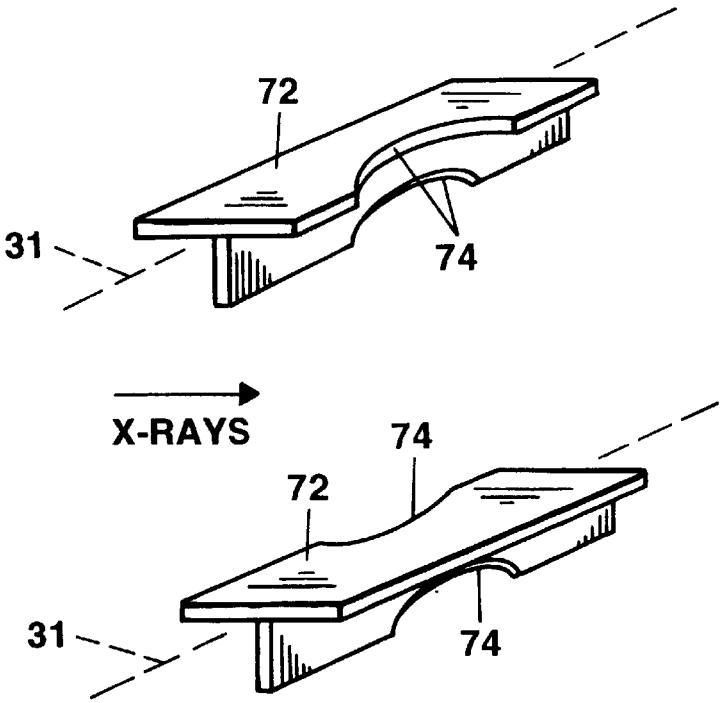
FIG. 10 is a view similar to FIG. 9, wherein the compensating filters are rotated 90° with reference to the horizontal plane.
Figure 9:
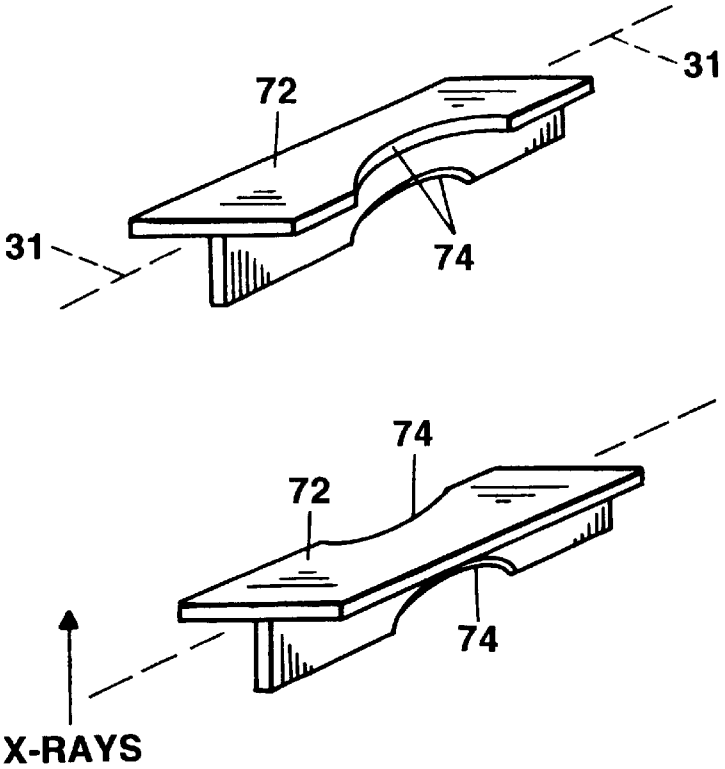
FIG. 9 is an enlarged perspective view of a pair of T-shaped compensating filters shown in FIG. 3.

FIGS. 9 and 10 schematically illustrate the two T-shaped filters (66). These filters (66) are substantially similar to the filters. Both filters (66) are aligned and parallel. The filters (66) have been provided with a flat top portion (72) and side openings (74) to follow the contours of the front, the sides and the rear portions of the head. For instance, the filters (66) in FIG. 9 are set to compensate the areas around the sides of the head of a patient, while in FIG. 10, the filters (66) are set for compensating the areas around the front and the rear of the head.

Figure 11:
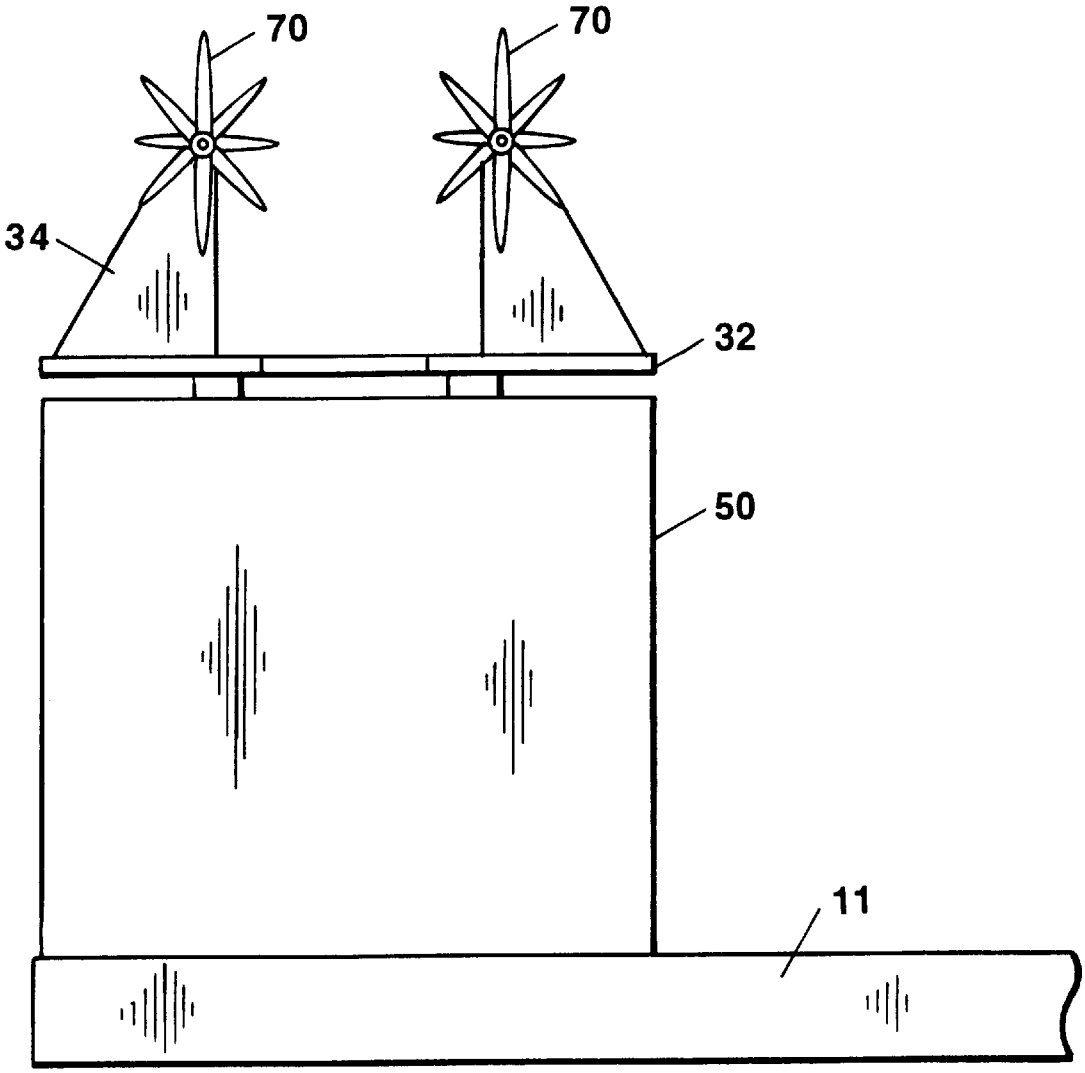
FIG. 11 is a side view of a pair of star-shaped compensating filters mounted in front of an X-ray source, according to another possible embodiment of the present invention.

FIG. 11 shows star-shaped filters (70) as another example of a compensating device (20). Each star-shaped filter (70) comprises four sections, each section comprising two opposite portions ending with a sharp wedge-shaped end to provide a gradual demarcation. One section is vertical, one section is horizontal and two sections are obliquely disposed at a 45° angle with reference to the horizontal and vertical sections.

The lower portion of the vertical section is heavier to maintain the proper balance by gravity, hence to maintain the proper alignment within the whole range of positions of the arms (11,12) of the apparatus (10). They may also comprise side openings similar to the side openings (74) in FIGS. 9 and 10.

Figure 12:
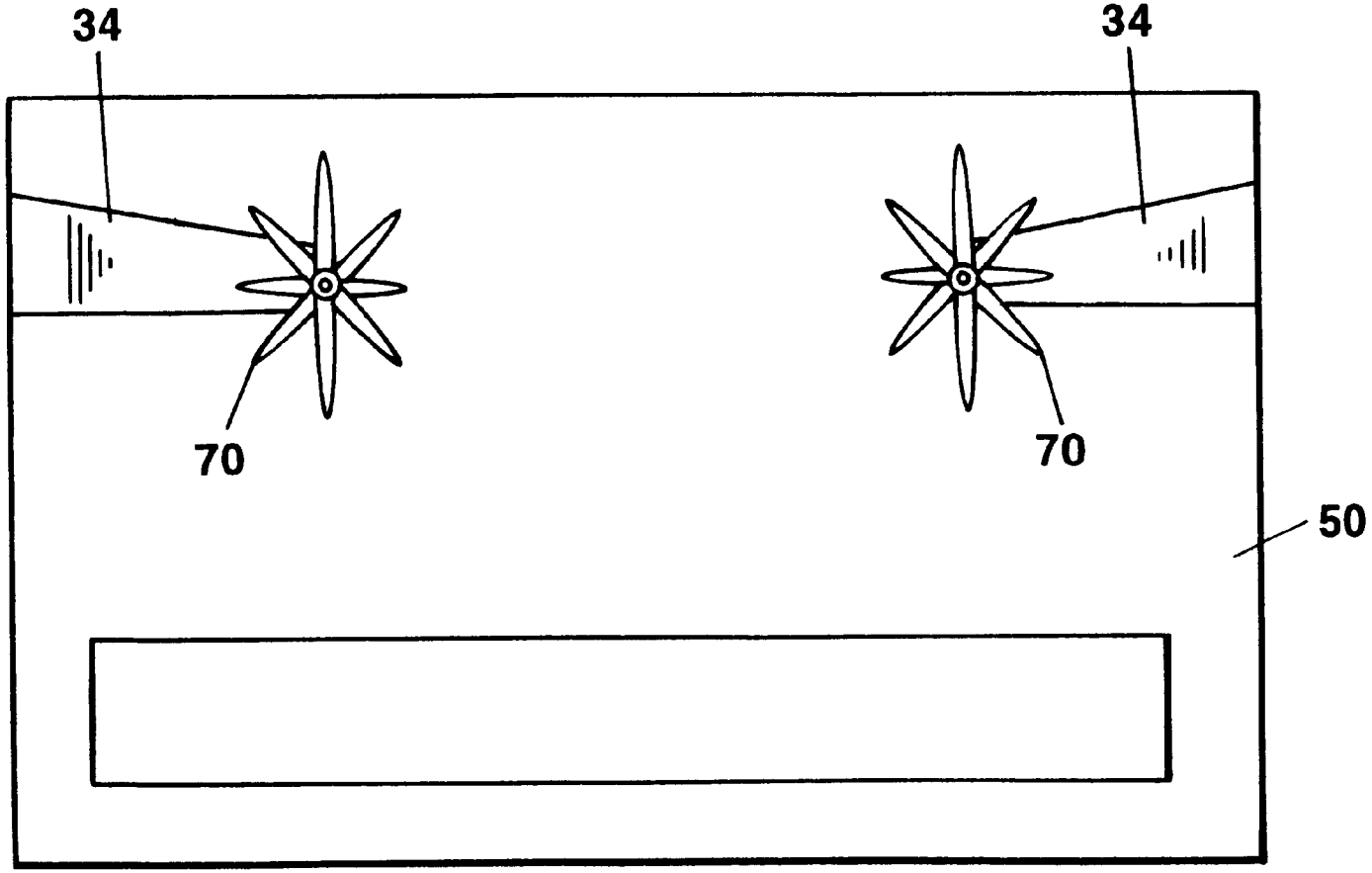
FIG. 12 is a side schematic view of star-shaped compensating filters mounted inside an X-ray source, according to another possible embodiment of the present invention.

As an alternative embodiment, as shown in FIG. 12, the scale of the star-shaped filters (70), or any of the compensating filters, can be reduced and inserted inside the housing of the X-ray source (50). The filters (70) are then protected from the surrounding environment.

Although preferred embodiments of the invention have been described in detail herein and illustrated in the accompanying drawings, it is to be understood that the invention is not limited to these precise embodiments and that various changes and modifications may be effected therein without departing from the scope or spirit of the invention. For instance, multiple other shapes of filters than those disclosed herein can be designed for achieving the same results.

What is claimed is:

1. A hyper-transparency compensating device for a gantry mounting radiography apparatus, the apparatus having a first and second opposite arms rotatable around a rotation axis, the first arm supporting an X-ray source and the second arm supporting an X-ray tube amplifier that is in registry with the X-ray source, the apparatus being used for radiographing an organ having a median plane in which the rotation axis is substantially lying, the device comprising:

at least one compensating filter defining a filter plane, the compensating filter having a longitudinal rotation axis;

a supporting assembly to pivotally support the compensating filter and allow a rotation thereof around the longitudinal rotation axis, the supporting assembly being connectable to the first arm of the gantry mounting apparatus, in front of the X-ray source and in registry with the X-ray source and the hyper transparency area while keeping the filter plane parallel to the reference plane during rotation of the arms around the axis.

2. A device according to claim 1, wherein the device comprises a three-dimensional scaled replica of human lungs in two parts, each part being in registry with one corresponding human lung.

3. A device according to claim 2, wherein each part of the compensating filter has a volume between ½ to ⅓ of the volume of the corresponding human lung.

4. A device according to claim 1, wherein the supporting assembly comprises an axis transparent to X-rays and extending between two opposite supporting arms.

5. A device according to claim 4, wherein the axis is made of a nylon cord.

6. A device according to claim 5, wherein the supporting assembly comprises a plate and connecting means for connecting the plate to the axis.

7. A device according to claim 6, wherein the connecting means comprises hooks.

8. A device according to claim 1, wherein the device comprises two spaced-apart and parallel isometric compensating filters, each in registry with the hyper transparency area around the organ.

9. A device according to claim 8, wherein each compensating filter comprises a bottom section heavier than an upper section thereof.

10. A device according to claim 9, wherein each compensating filter is T-shaped.

11. A device according to claim 10, wherein each compensating filters further comprises at least one side opening to follow a contour of the organ.

12. A device according to claim 11, further comprising at least one peripheral filter set directly over the patient.

13. A device according to claim 9, wherein each compensating filter is star-shaped.

14. A device according to claim 13, wherein each compensating filters further comprises at least one side opening to follow a contour of the organ.

15. A device according to claim 14, further comprising at least one peripheral filter set directly over the patient.

* * * * *